US006795678B2

(12) United States Patent
Yura et al.

(10) Patent No.: US 6,795,678 B2
(45) Date of Patent: Sep. 21, 2004

(54) IMAGE FORMING APPARATUS FOR FIXING A TONER IMAGE ON A SHEET OR RECORDING MEDIUM BY USE OF A BELT MEMBER

(75) Inventors: Jun Yura, Yokohama (JP); Takashi Fujita, Tokyo (JP); Katsuhiro Echigo, Asaka (JP); Shigeo Kurotaka, Sagamihara (JP); Toshihiko Baba, Funabashi (JP); Hisashi Kikuchi, Kawasaki (JP); Atsushi Nakafuji, Tokyo (JP); Hirokazu Ikenoue, Inagi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/306,082

(22) Filed: Nov. 29, 2002

(65) Prior Publication Data

US 2003/0103788 A1 Jun. 5, 2003

(30) Foreign Application Priority Data

Nov. 29, 2001 (JP) ..... 2001-363843

(51) Int. Cl.[7] ..... G03G 15/20
(52) U.S. Cl. ..... 399/329; 219/216
(58) Field of Search ..... 399/328, 329; 219/216; 432/60

(56) References Cited

U.S. PATENT DOCUMENTS

| | | | | |
|---|---|---|---|---|
| 5,493,365 A | | 2/1996 | Matsui et al. | |
| 5,592,275 A | | 1/1997 | Echigo et al. | 399/325 |
| 5,678,161 A | | 10/1997 | Kurotaka et al. | 399/400 |
| 5,708,949 A | | 1/1998 | Kasahara et al. | 399/330 |
| 5,784,678 A | * | 7/1998 | Matsuura et al. | 399/329 |
| 5,832,353 A | * | 11/1998 | Sano | 399/329 |
| 5,873,020 A | * | 2/1999 | Matsuura et al. | 399/329 |
| 6,055,390 A | | 4/2000 | Kurotaka et al. | 399/69 |
| 6,078,766 A | | 6/2000 | Kurotaka | 399/165 |
| 6,088,558 A | | 7/2000 | Yamada et al. | 399/165 |
| 6,108,906 A | | 8/2000 | Fujita et al. | 29/895.211 |
| 6,122,479 A | | 9/2000 | Fujita et al. | 399/333 |
| 6,198,888 B1 | | 3/2001 | Kurotaka et al. | 399/69 |
| 6,243,559 B1 | | 6/2001 | Kurotaka et al. | 399/329 |
| 6,262,787 B1 | | 7/2001 | Kamoi et al. | 349/96 |
| 6,347,212 B1 | | 2/2002 | Kosugi et al. | 399/348 |
| 6,366,751 B1 | | 4/2002 | Shakuto et al. | 399/159 |
| 6,501,935 B2 | | 12/2002 | Hirai et al. | 399/329 |
| 6,577,840 B2 | * | 6/2003 | Hachisuka et al. | 399/329 |

* cited by examiner

*Primary Examiner*—William J. Royer
(74) *Attorney, Agent, or Firm*—Oblon, Spivak, McClelland, Maier & Neustadt, P.C.

(57) ABSTRACT

A fixing device for an image forming apparatus of the present invention includes an endless belt passed over a plurality of members for conveying a sheet in contact with a toner image carried thereon. A pressing member faces the above members with the intermediary of the belt. A first member, which is one of the plurality of members, constitutes a heating member for heating the belt. A second member, which is another one of the members, faces the pressing member with the intermediary of the belt. A third member, which is another one of the members, constitutes a stationary member facing the pressing member with the intermediary of the belt. The pressing member and first member and the pressing member and second member respectively form a first and a second nip therebetween. The toner image on the sheet is fixed by being sequentially conveyed via the first and second nips.

19 Claims, 9 Drawing Sheets

IMAGE FORMING APPARATUS FOR FIXING A TONER IMAGE ON A SHEET OR RECORDING MEDIUM BY USE OF A BELT MEMBER

BACKGROUND OF THE INVENTION

1. Field of the Invention

The present invention relates to a copier, facsimile apparatus, printer or similar image forming apparatus and more particularly to a fixing device included in an image forming apparatus for fixing a toner image carried on a sheet or recording medium by using a belt.

2. Description of the Background Art

An image forming apparatus includes a fixing device for fixing a toner image carried on a sheet or recording medium with heat. One of the conventional fixing devices is configured to convey a sheet with a pair of rollers while causing one of the rollers to heat a toner carried on the sheet. Another conventional fixing device includes a roller and a belt so positioned as to form a nip there between, as disclosed in, e.g., Japanese Patent Laid-Open Publication No. 10-307496. Generally, a belt can be made smaller in volume and therefore in thermal capacity than a roller and can be warmed up in a short period of time. Warm-up time is therefore shorter with the combination of a roller and a belt than with only a roller.

However, a problem with the fixing device of the type using a belt is that the belt lacks flatness, i.e., it is apt to wave or slacken. If the belt waves or slackens, then it is likely that a toner image carried on a sheet is shifted or that toner is transferred from the sheet to the belt, resulting in a defective image. Another problem is that after the toner image has been fixed on the sheet, the sheet cannot be surely separated from the belt.

Technologies relating to the present invention are also disclosed in, e.g., Japanese Patent Laid-Open Publication Nos. 9-160405, 10-307493, 11-2979 and 11-45025.

SUMMARY OF THE INVENTION

It is an object of the present invention to provide a fixing device of the type using a belt as one of members for forming a nip and capable of obviating defective images ascribable to the waving or the slackening of the belt, and an image forming apparatus including the same.

It is another object of the present invention to provide a fixing device capable of surely separating a sheet after the fixation of a toner image carried on the sheet, and an image forming apparatus including the same.

A fixing device included in an image forming apparatus fixing a toner image carried on a sheet of the present invention includes an endless belt passed over a plurality of members for conveying the sheet in contact with the toner image carried thereon. A pressing member faces the plurality of members with the intermediary of the belt. A first member, which is one of the plurality of members, constitutes a heating member for heating the belt. A second member, which is another one of the plurality of members, faces the pressing member with the intermediary of the belt. A third member, which is another one of the plurality of members, constitutes a stationary member facing the pressing member with the intermediary of the belt. The pressing member and first member and the pressing member and second member respectively form a first and a second nip therebetween. The toner image on the sheet is fixed by being sequentially conveyed via the first and second nips.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, reference will be made to the prior art fixing device taught in Japanese Patent Laid-Open Publication No. 10-307496 mentioned earlier. As shown, the fixing device includes a belt C passed over a pair of rollers A and B. A press roller D faces the roller A and presses a sheet S carrying a toner image T thereon against the roller A via the belt C, which faces the toner image T. The rollers B and D are implemented as heat rollers accommodating heat sources B1 and D1, respectively, and heat the toner image T. Generally, a belt combined with a roller is advantageous over only a roller for the reason stated previously.

Figure 1:
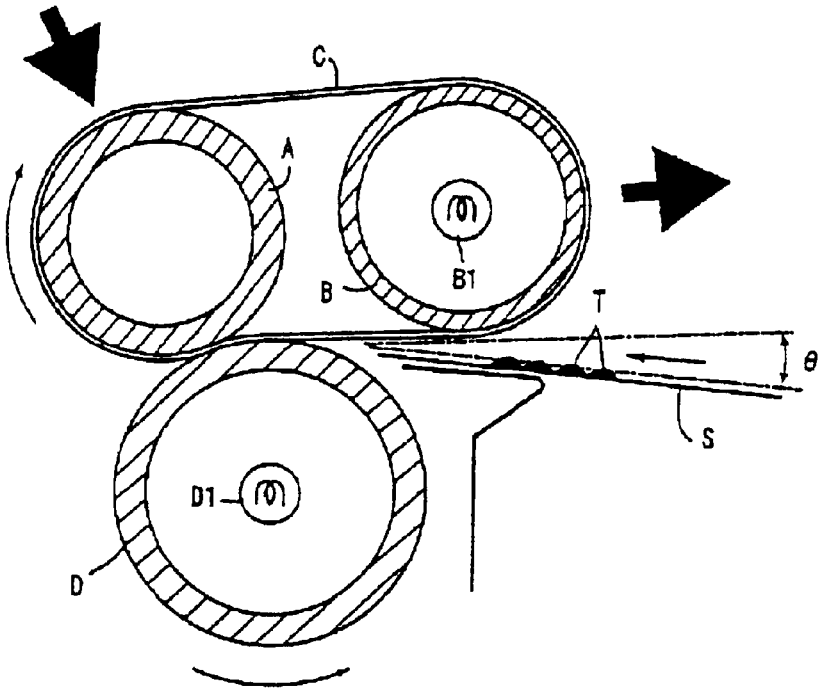
FIG. 1 PRIOR ART
FIG. 1 shows a specific, conventional fixing device.

The belt C, contacting the heat roller D, forms a first nip at the upstream side in a direction indicated by an arrow in FIG. 1, i.e., a direction in which the sheet S is conveyed. Also, the belt C, contacting the roller A, forms a second nip contiguous with the first nip at the downstream side in the above direction. The sheet S enters the first nip and is conveyed between the belt C and the heat roller D toward the second nip. The sheet S passes through the second nip and is separated from the belt C by the curvature of the roller A. Using the belt C is therefore more desirable than using only a roller pair because the sheet S can be heated over a broader range.

To guarantee the second nip between the belt C and the heat roller D, the other heat roller B is positioned upstream of the first nip in the direction of sheet conveyance. Therefore, the sheet S moving toward the first nip must enter a space having an extremely small angle θ between the belt C and the roller D and adjoins the belt C during movement. This gives rise to a problem that when the belt C or the sheet S is not flat, but waves or slackens, the toner image T on the sheet S is apt to contact the belt C, resulting in the dislocation of the toner image T or the undesirable transfer thereof to the belt C.

In light of the above, Japanese Patent Laid-Open Publication No. 9-160405 mentioned earlier proposes to press the belt C against the roller D with an elastic pressing member, which is held in contact with the inner surface of the belt C at the inlet side of the first nip. Also, Japanese Patent Laid-Open Publication Nos. 11-45025 and 10-307493 each propose to press the belt C against the roller D with a pad-like pressing member, which is positioned in the range around the second nip.

Figure 2:
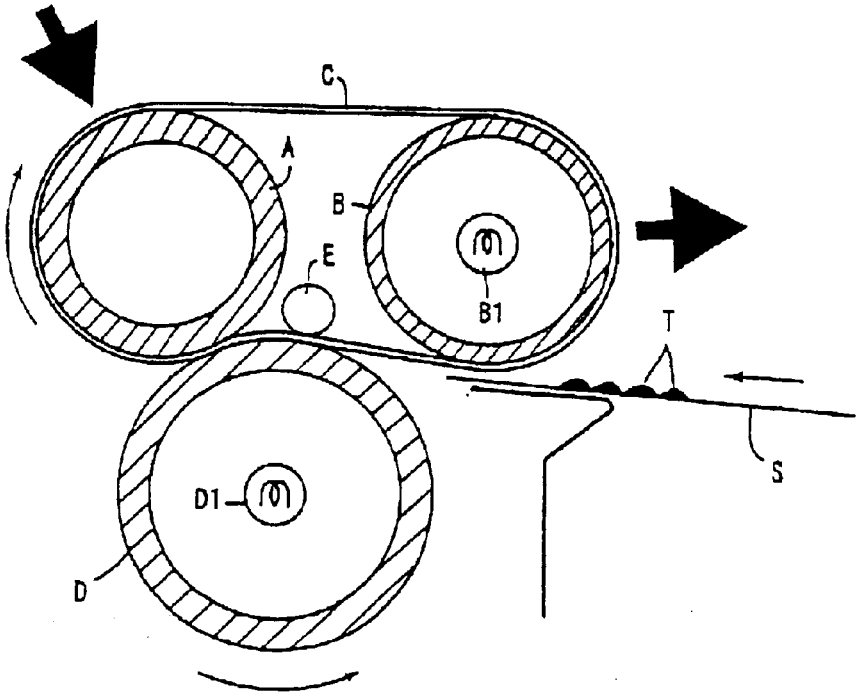
FIG. 2 PRIOR ART
FIG. 2 shows another specific, conventional fixing device configured to solve a problem particular to the fixing device of FIG. 1.

However, the elastic pressing member mentioned above is apt to bring about a problem as to its slide on the belt and wear resistance, obstructing reliable movement of the belt, i.e., reliable sheet conveyance. For this reason, as shown in FIG. 2 and as shown and described in Laid-Open Publication No. 9-160405, the elastic pressing member must be implemented as a roller E and must therefore be provided with a bearing structure. Further, the roller E presses the belt C with only part of its circumference, i.e., over an extremely narrow range and cannot surely prevent the belt C from slackening or rising.

On the other hand, the pad-like pressing member, pressing the C belt against the roller D, forms a nip at a position where it faces the C belt in addition to the nip between the roller D and the belt C. Such a plurality of nips are apt to produce a difference in peripheral speed between facing members due to slip or the distortion of the roller, resulting in defective images. More specifically, the toner image T heated at the upstream nip in the direction of sheet conveyance is transferred to the belt C (offset) in a half-melted condition and again transferred from the belt C to the position of the sheet S shifted from the toner image T at the downstream nip. The resulting defect becomes more conspicuous with a decrease in the length of the upstream nip where the toner image T is initially melted. Particularly, in the configuration shown in FIG. 2, the nip formed by only part of the circumference of the roller E is extremely short and is apt to bring about defective images.

To obviate defective images ascribable to the retransfer of toner, it is necessary to guarantee the length of the nip between the heat roller and the belt. However, the length of the nip cannot be increased unless the circumferential length of the heat roller is increased, so that the radius of curvature of the heat roller cannot be reduced. Consequently, the temperature of the heat roller cannot be rapidly elevated, and therefore sharp temperature elevation particular to a belt is not achievable.

To insure contact of the heat roller with the sheet at the nip, the sheet may be pressed against the heat roller by a heavy load. The heavy load, however, increases a load on the movement of the belt at the inlet of the nip and thereby makes it difficult to implement reliable belt movement, i.e., reliable sheet conveyance and belt durability.

On the other hand, the nip length can be increased if a roller facing a heat roller and allowing a belt to form a nip is provided with an elastic rubber layer in order to enhance close contact of the belt with the heat roller, as proposed in the past. However, the roller that presses the belt against the heat roller via its rubber layer must be provided with some rigidity and therefore have a thick wall. Such a roller has great thermal capacity and slows down temperature elevation. Alternatively, the nip length may be increased by increasing the circumferential length and therefore radius of curvature of the heat roller. This kind of scheme, however, is apt to make the curvature-based separation of a sheet passed through the nip insufficient. This is particularly true when a parting agent is not used in order to obviate toner offset.

Figure 3:
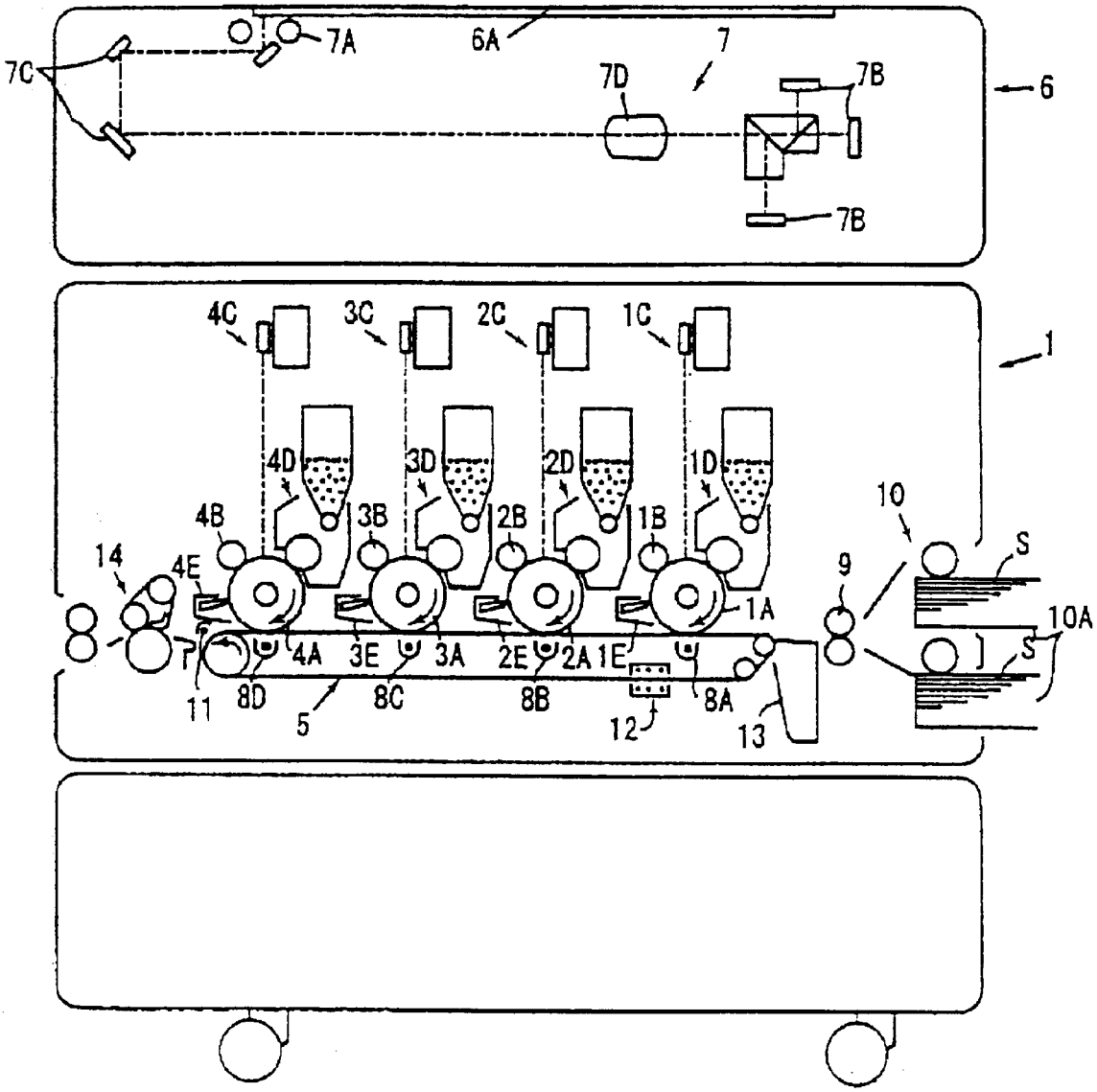
FIG. 3 shows an image forming apparatus to which preferred embodiments of the present invention are applied.

Referring to FIG. 3, an image forming apparatus to which preferred embodiments of the present invention, which will be described hereinafter, are applied is shown and implemented as a color copier or a color printer by way of example. Of course, the image forming apparatus may be of the kind producing monochromatic images. As shown, the image forming apparatus, generally 1, includes four photoconductive drums 1A, 2A, 3A and 4A each being assigned to one of yellow, cyan, magenta and black. Toner images of different colors formed on the drums 1A through 4A are sequentially transferred to a sheet or recording medium S, which is being conveyed by an image transfer belt 5, one above the other to thereby complete a full-color image.

The image processing system of the illustrative embodiment will be described hereinafter, taking the drum 1A by way of example. Because the system to be described applies to the other drums 2A through 4A as well, structural elements associated with the drums 2A through 4A are simply distinguished from structural elements associated with the drum 1A by prefixes.

As shown in FIG. 3, a charger 1B, an optical writing unit 1C using laser optics, a developing unit 1D and a cleaning unit 1E are sequentially arranged around the drum 1A in the direction of rotation of the drum 1A indicated by an arrow. The charger 1B is implemented as a roller although it may be implemented as a corotron or scorotron charger by way of example. A document reading unit (scanner hereinafter) 6 is positioned above the image forming section including the drum 1A, charger 1B, writing unit 1C, developing unit 1D, and cleaning unit 1E. The scanner 6 includes scanning optics that reads image information out of a document laid on a glass platen 6A while sending the image information to an image processing section not shown. The image processing section processes the image information and delivers the resulting image data to the writing unit 1C.

Developing devices 1D, 2D, 3D and 4D are arranged along the belt 5 in this order from the right to the left, as viewed in FIG. 3, and assigned to yellow, cyan, magenta and black, respectively.

The scanning optics 7 includes a light source 7A for illuminating the document laid on the glass platen 6A. Imagewise reflection from the document is incident to CCDs (Charge Coupled Devices) 7B via a plurality of mirrors 7C and a lens 7D. The CCDs 7B each are assigned to one of three separated colors. As a result, the CCDs 7B send image information corresponding to the intensities of incident light of different colors to the image processing section.

The image transfer belt 5 is implemented as a polyester film or similar member formed of a dielectric substance and passed over a plurality of rollers. The upper run of the belt 5, as viewed in FIG. 3, faces the drums 1A through 4A. Image transfer devices 8A, 8B, 8C and 8D respectively face the drums 1A through 4A with the intermediary of the upper run of the belt 5. A sheet S is fed from a sheet cassette 10A, which is included in a sheet feeder 10, to the belt 5 via a registration roller pair 9. The image transfer device 8A causes the sheet S to electrostatically adhere to the belt 5 by corona discharge, so that the belt 5 conveys the sheet S.

A sheet separator 11 is located at a position to which the sheet S is conveyed after the consecutive transfer of toner images from the drums 1A to 4A. A pair of dischargers 12 face each other with the intermediary of the lower run of the belt 5, as viewed in FIG. 3. A cleaning unit 13 removes toner left on the belt 5 after image transfer. The chargers 8A through 8D effect corona discharge of positive polarity for electrostatically transferring images from the drums 1A through 4A, respectively, to the sheet S.

The sheet separator 11 effects AC corona discharge of negative polarity over the sheet S to thereby neutralize charge deposited on the sheet S. As a result, the sheet S is released from electrostatic restraint and is separated from the belt 5 due to the curvature of the belt 5. At the same time, the sheet separator 11 prevents toner from being scattered by exfoliation discharge. The dischargers 12 apply AC corona discharge of negative polarity opposite to the polarity of the image transfer devices 8A through 8D at opposite sides of the belt 5, thereby electrically initializing the belt 5.

The charger 1B uniformly charges the surface of the drum 1A. The writing unit 1C scans the charged surface of the drum 1A with a laser beam in accordance with the image data received from the image processing section, thereby forming a latent image on the drum 1A. Subsequently, the developing device 1D develops the latent image with yellow toner complementary to the color of the image data to thereby produce a yellow toner image. The yellow toner image is transferred from the drum 1A to the sheet S, which is being conveyed by the belt 5, by the image transfer device 8A. Chargers 2B through 4B, writing devices 2C through 4C, developing devices 2D through 4D and image transfer devices 8B through 8D are assigned to the other drums 2A through 4A in the same manner as the charger 1B, writing device 1C, developing device 1D and image transfer device 8A. A cyan, a magenta and a black toner image are sequentially transferred from the drums 2A through 4A to the sheet S above the yellow toner image present on the sheet S, thereby completing a full-color toner image.

The sheet S with the full-color toner image is discharged by the discharger 11, separated by the curvature of the belt 5, and then brought to a fixing device 14 to have the toner image fixed thereby.

Figure 4:
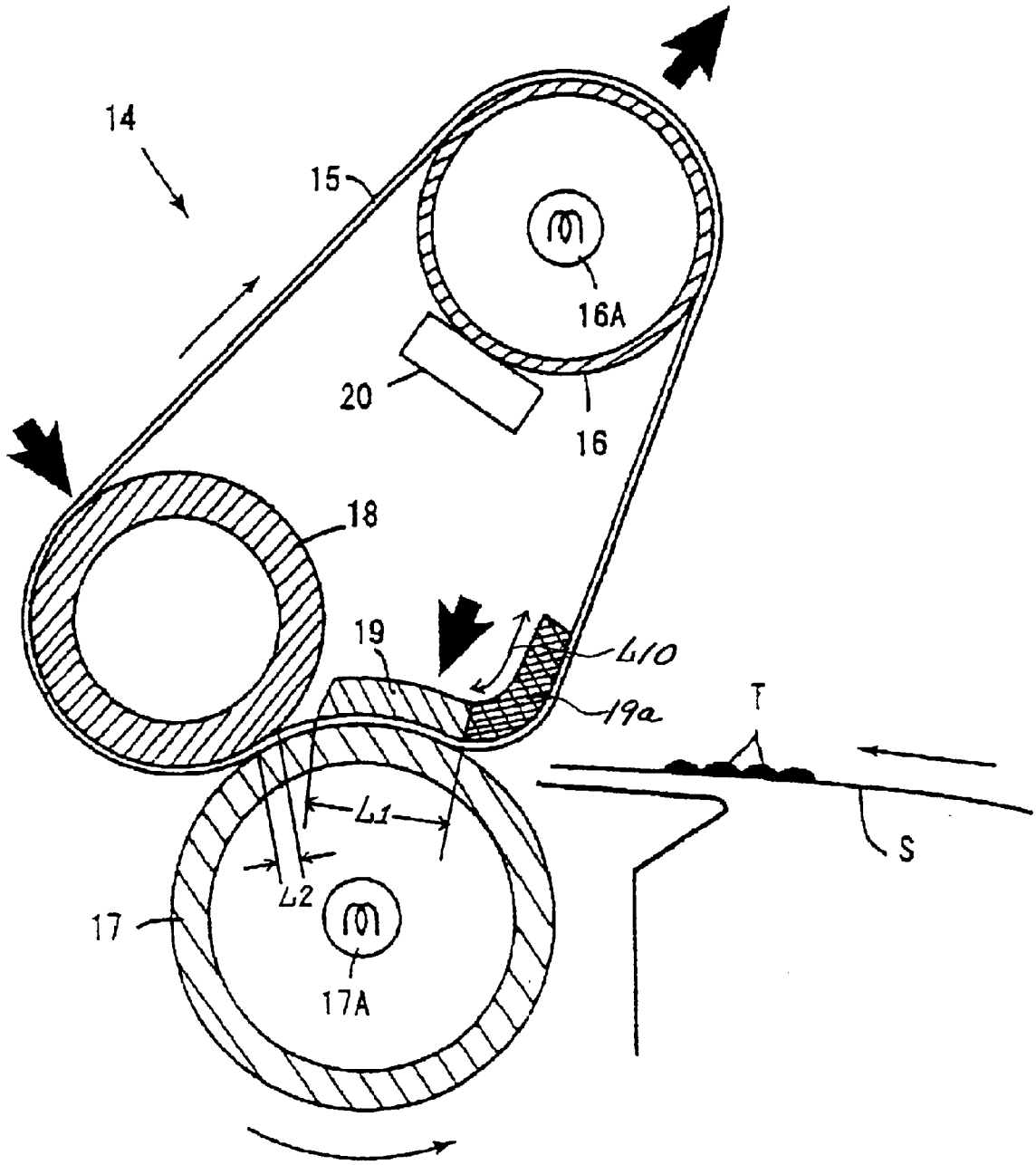
FIG. 4 shows a first embodiment of the fixing device in accordance with the present invention.

FIG. 4 shows a first embodiment of the fixing device 14 in accordance with the present invention specifically. As shown, the fixing device 14 includes an endless belt 15 passed over a plurality of members and capable of conveying the sheet S, which carries the toner image or toner T thereon. One of the plurality of members over which the belt 15 is passed is a heat roller or first member 16 accommodating a halogen heater or heat source 16A. Another member is a fixing roller or second member 18 facing a press roller 17 with the intermediary of the belt 15. Still another member is a stationary member or third member 19 located between the heat roller 16 and fixing roller 18 and over which the belt 15 is also passed. The stationary member 19 will be described in detail later.

The belt 15 includes a base formed of heat-resistant resin, e.g., polyimide, polyamide or polyether ketone (PEEK). The base has a thickness selected to be about 30 $\mu$m to 100 $\mu$m in consideration of balance between heat conduction and mechanical strength. The surface of the base is covered with a parting layer formed of fluorocarbon resin or similar substance desirable in the aspect of parting ability and heat resistance when brought into contact with the sheet S and toner T under pressure. Further, a 100 $\mu$m to 300 $\mu$m thick elastic layer intervenes between the base and the parting layer and is formed of silicone rubber, fluororubber or similar heat-resistant rubber, allowing the belt 15 to uniformly contact the toner T.

The heat roller 16 is implemented as a hollow aluminum (Al) or iron (Fe) roller whose wall is as thin as about 0.3 mm to 1 mm and has a diameter of 20 mm to 30 mm. The halogen heater 16A is disposed in the heat roller 16 while a temperature control member 20 is held in contact with the heat roller 16. The halogen heater 16A is turned on in accordance with temperature being sensed by the temperature control member 20, thereby maintaining the surface of the heat roller 16 at a preselected temperature. To allow the heat roller 16 to bifunction as a tension roller for the belt 15, a tension spring or similar biasing means, not shown, constantly biases the heat roller 15 in a direction indicated by a bold arrow in FIG. 4.

The press roller 17 is made up of an Al or Fe core, an elastic layer formed of, e.g., fluororubber or silicone rubber and covering the core, and a parting layer covering the elastic layer and formed of fluorocarbon resin. In the illustrative embodiment, the elastic layer is selected to be 0.5 mm to 5 mm thick so as to provide the surface of the press roller 17 with a hardness of 70 Hc to 90 Hc in terms of Asker C scale. A halogen heater or another heat source 17A may be disposed in the press roller 17 in order to accelerate the temperature elevation of the surface of the press roller 17.

The fixing roller 18 is made up of an Fe core having a predetermined diameter and a heat-resistant elastic layer covering the Fe core and formed of, e.g., foam silicone rubber or liquid silicone rubber. The elastic layer allows the fixing roller 18 to form a nip and is provided with thickness of 3 mm to 6 mm and surface hardness of 30 Hs to 50 Hs in terms of Asker C scale.

The stationary member 19 is formed of metal or resin and so located as to press the belt 15 against the circumference of the belt 15 together with the fixing roller 18. In the illustrative embodiment, the stationary member 19 is located at a position where the belt 15 begins to be pressed against the press roller 17. In this sense, the stationary member 19 forms a portion over which the belt 15 is passed and a portion pressing the belt 15 against the press roller 17 at the same time.

More specifically, the stationary member 19 is formed of iron, stainless steel, aluminum or similar metal or polyphenylene sulfide (PPS) or similar heat-resistant resin. Part of the surface of the stationary member 19 facing the press roller 17 is formed so as to be flat or arcuate shaped complementarily to the circumference of the press roller 17, insuring the close contact of the belt 15 with the press roller 17.

A plurality of parallel grooves, not shown, are formed in the surface of the stationary member 19 facing the belt 15 in the direction perpendicular to the direction of sheet conveyance, and each extends in the direction parallel to the direction of sheet conveyance. In the illustrative embodiment, each groove is 0.2 mm to 0.5 mm wide and 0.2 mm to 0.5 mm deep. Further, a friction reducing portion is provided on the surface of the stationary member 19 facing the belt 15. In the illustrative embodiment, the friction reducing portion is implemented as a laminate of sheets of Teflon (trade name) or similar fluorocarbon resin or glass fibers. The laminate may be wrapped around the above surface of the stationary member 19 or formed by coating.

The stationary member 19, pressing the belt 15 against the press roller 17 together with the fixing roller 18, forms a first nip L1 at the upstream side in the direction of sheet conveyance. In addition, the stationary member 19 includes an inlet portion 19*a* preceding the first nip L1. The inlet portion 19*a* forms a guide portion L10 that allows the belt 15 moving on the surface of the stationary member 19 to immediately introduce the sheet S into the first nip L1. The fixing roller 18, pressing the belt 15 against the press roller 17, forms a second nip L2.

The end of the stationary member 19 facing the fixing roller 18 is positioned as close to the fixing roller 18 as possible in order to minimize the distance between the above end and the fixing roller 18, i.e., between the end of the first nip L1 and that of the second nip L2 adjoining each other. This successfully minimizes the distance over which the belt 15 moving along the circumference of the press roller 17 is released from the nip, thereby preventing the sheet S from rising.

In the illustrative embodiment, the length of the first nip L1 is selected to be greater than the length of the second nip L2. In this condition, the period of time over which the sheet S entered the first nip L1 receives heat is extended, so that the toner T on the sheet S is softened to a rubber state by heat; otherwise, the toner T would be transferred from the sheet S to the belt 15 and again transferred to another portion of the sheet S, resulting in a defective image.

Further, in the illustrative embodiment, pressure P1 acting at the first nip L1 for a unit area is selected to be lower than pressure P2 acting at the second nip L2 for the unit area, so that a load acting on the belt 15 at the nip L1 is lighter than a load acting on the same at the nip L2. The stationary member 19 therefore does not obstruct the movement of the belt 15 and obviates a difference in peripheral speed between the belt 15 and the press roller 17.

As stated above, in the illustrative embodiment, the sheet S carrying the toner image T thereon and reached the fixing device 14 is immediately guided by the stationary member 19 into the first nip L1 between part of the belt 15 pressed against the press roller 17 by the stationary member 19 and the press roller 17. At this instant, the guide portion L10 preceding the first nip L1 and over which the belt 15 is passed guarantees a broad space for the sheet S to enter the first nip L1, preventing the sheet S from contacting the belt 15. It follows that even if the belt 15 or the sheet S waves or creases, the toner T is prevented from being rubbed by the belt 15 or transferred to the belt 15.

Furthermore, the sheet S moves over a longer distance at the first nip L1 than at the second nip L2. This, coupled with the fact that the pressure acting on the sheet S at the first nip L1 is lower than the pressure acting thereon at the second nip L2, minimizes heat and pressure required at the first nip L1 and thereby prevents the load acting on the belt 15 from increasing. In addition, a period of time necessary for the toner T on the sheet S to be softened by heat is guaranteed, so that the toner T becomes as soft as rubber and prevents the sheet S and belt 15 from being shifted relative to each other and rendering the image defective.

Moreover, the stationary member or guide 19 located at the inlet of the first nip L1 presses the sheet S against the press roller 17 for thereby preventing the sheet S from contacting the adjoining member, i.e., belt 15. Therefore, it is not necessary to use an exclusive member for forming the first nip L1 in addition to a member over which the belt 15 is to be passed.

Figure 5:
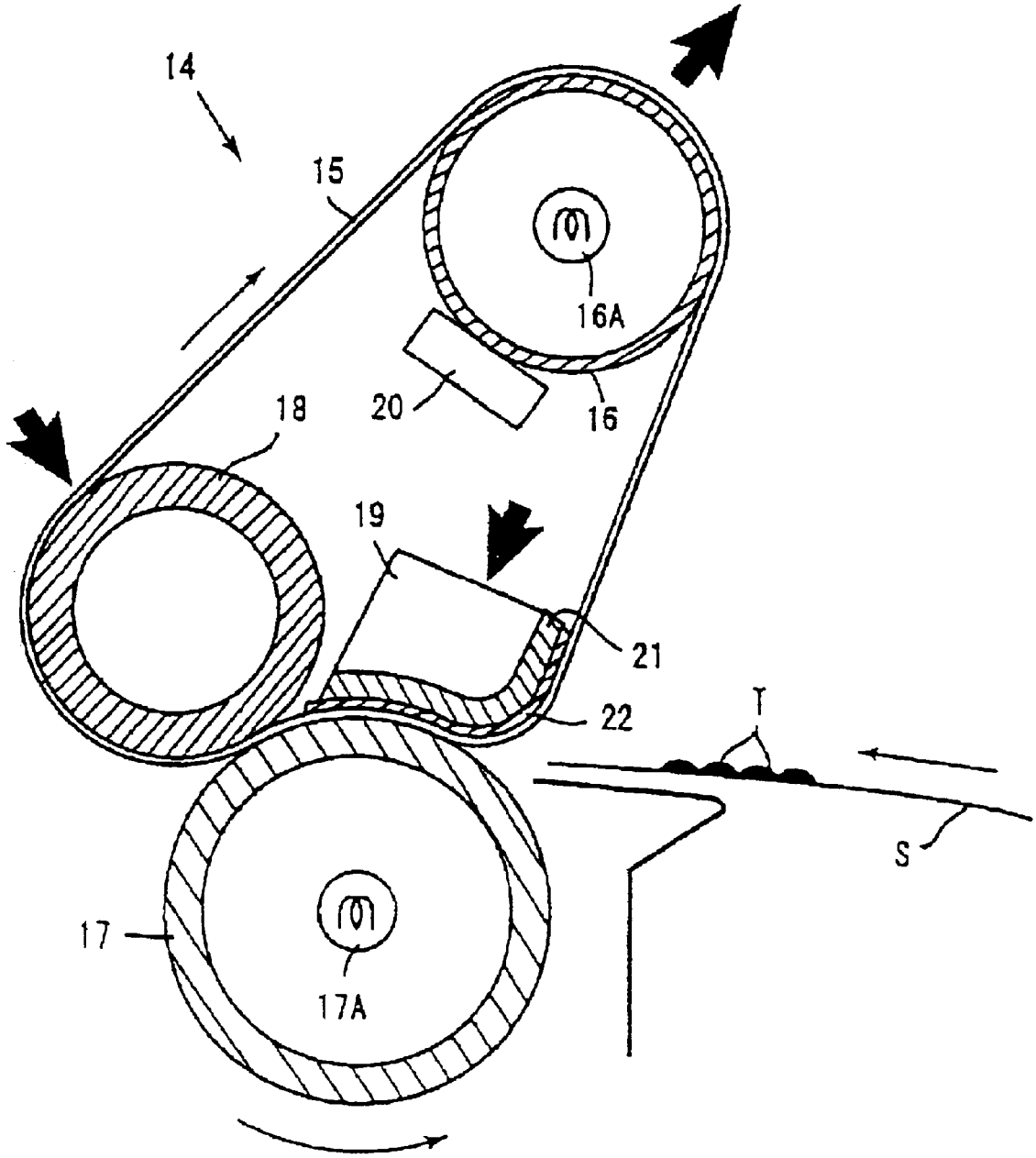
FIG. 5 shows a second embodiment of the fixing device in accordance with the present invention.

FIG. 5 shows a second embodiment of the fixing device 14 in accordance with the present invention. As shown, the fixing device 14 is identical with the fixing device 14 of the first embodiment except for the configuration of the stationary member 19. In the illustrative embodiment, a 1 mm to 5 mm thick elastic layer 21 is formed on the surface of the stationary member 19 facing the belt 15 and is formed of foam silicone rubber or liquid silicone rubber. Further, a friction reducing layer 22 is formed on the surface of the elastic layer 21 facing the belt 15 and is implemented as a sheet of fluorine-containing substance or glass fibers. Alternatively, the friction reducing layer 22 may be implemented as a piece of felt formed of glass or ceramics, if desired.

In the above configuration, the elastic layer 21 not only insures the uniform contact of the stationary member 19 with the belt 15 at the first nip L1, but also absorbs any excessive load, which may act on the belt 15, by elastic deformation. This is also successful to obviate a difference in peripheral speed between the sheet S and the belt 15 and therefore defective images ascribable thereto.

Figure 6:
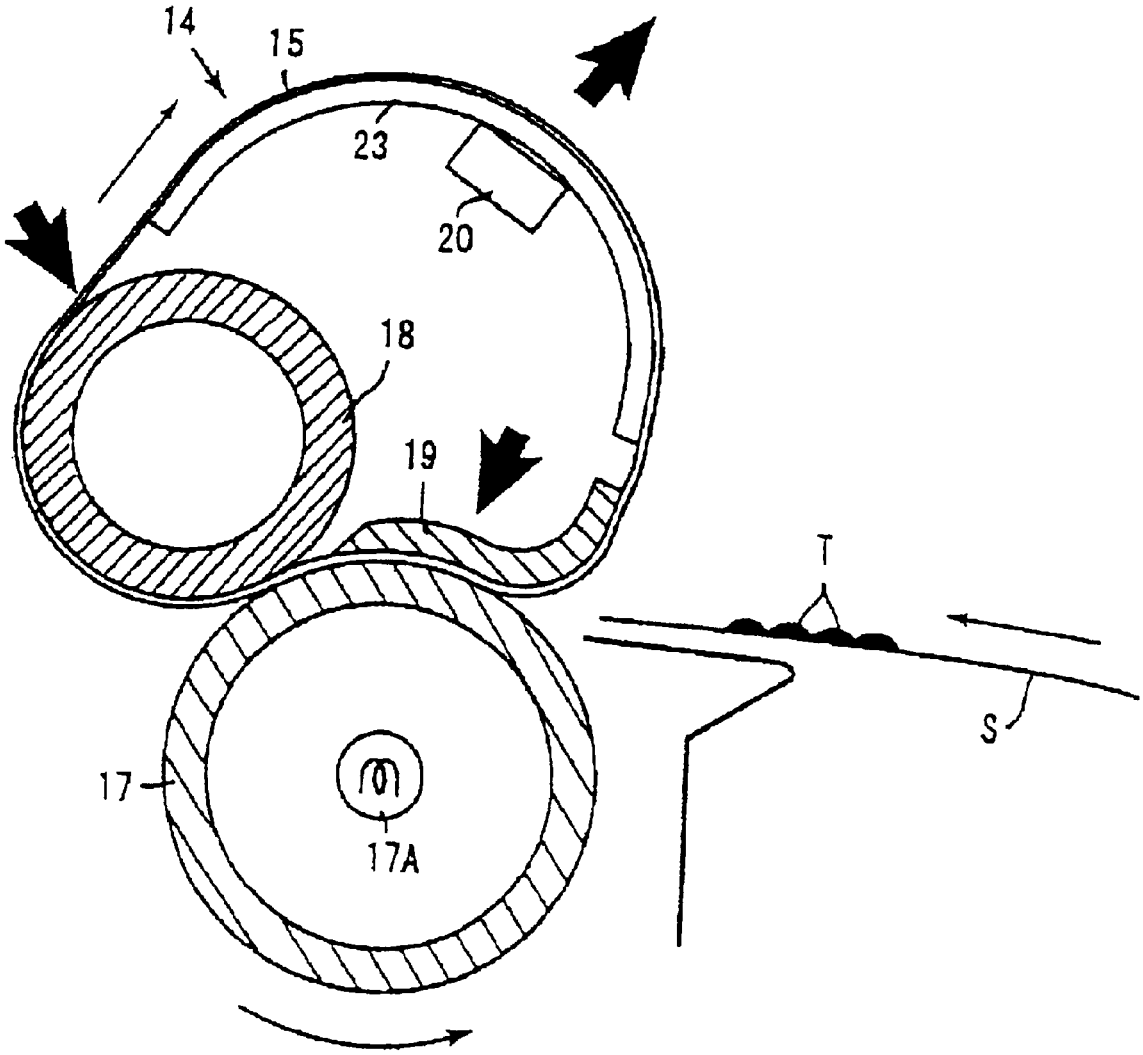
FIG. 6 shows a third embodiment of the fixing device in accordance with the present invention.

FIG. 6 shows a third embodiment of the fixing device 14 in accordance with the present invention. As shown, the fixing device 14 includes an arcuate, planar heater 23 in place of the heat roller 16 so as to increase the heating area. More specifically, the planar heater 23 is made up of an Fe or Al base, a thin insulation layer formed on the base and formed of, e.g., ceramics or polyimide, and a resistance-heating layer formed on the insulation layer and formed of, e.g., silver (Ag). The planar heater 23 is capable of heating the belt 15 in a smaller space than the heat roller 16 and has thermal capacity small enough to reduce warm-up time. The planar heater 23 is supported at opposite edges thereof by members, not shown, and constantly biased by biasing means, not shown, in a direction indicated by a bold arrow in FIG. 6 to thereby apply tension to the belt 15.

Figure 7:
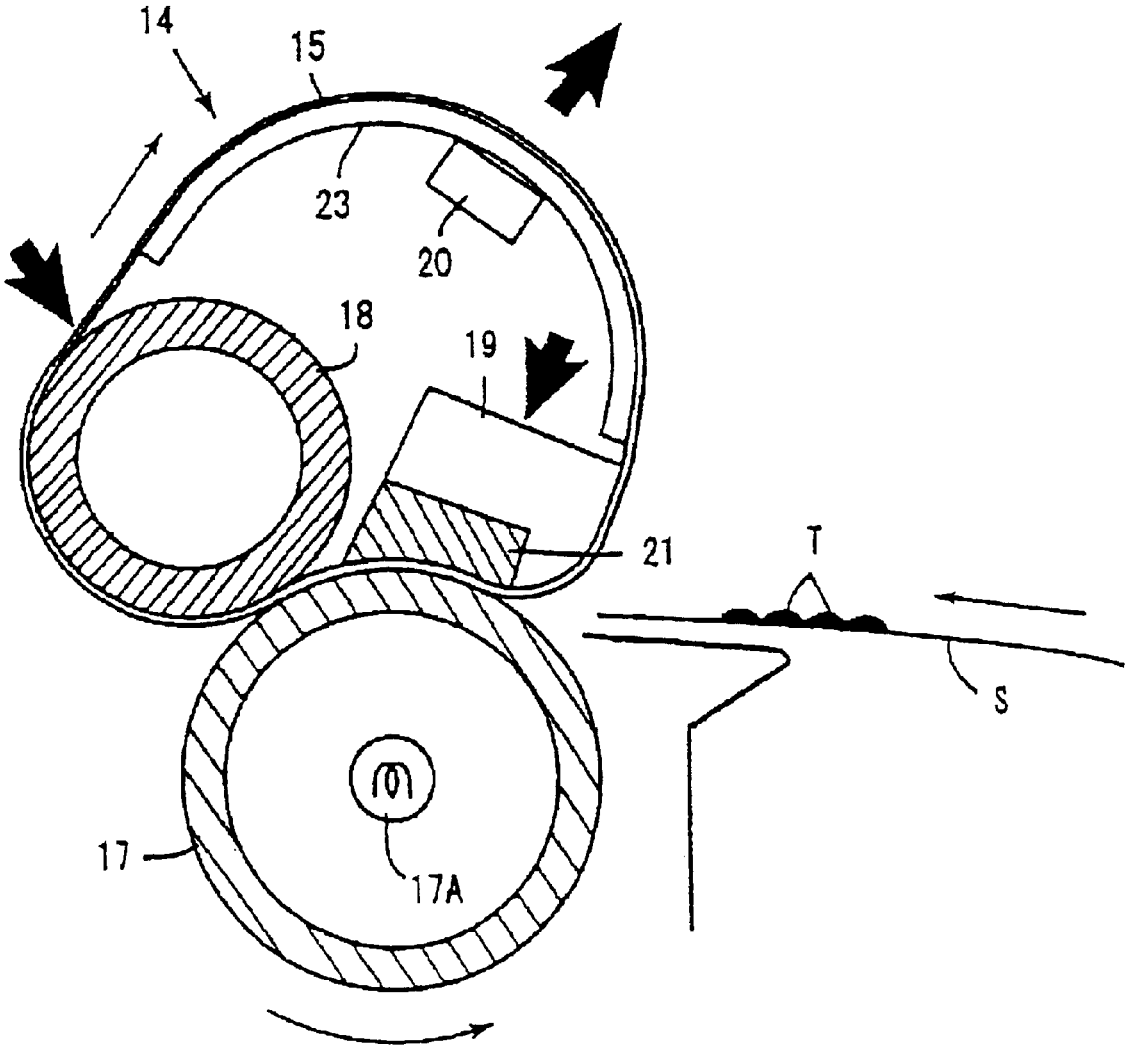
FIG. 7 shows a fourth embodiment of the fixing device in accordance with the present invention.

The configuration of the planar heater 23 may be similarly applied to the configuration of FIG. 5, as shown in FIG. 7 as a fourth embodiment of the fixing device 14 in accordance with the present invention specifically.

Figure 8:
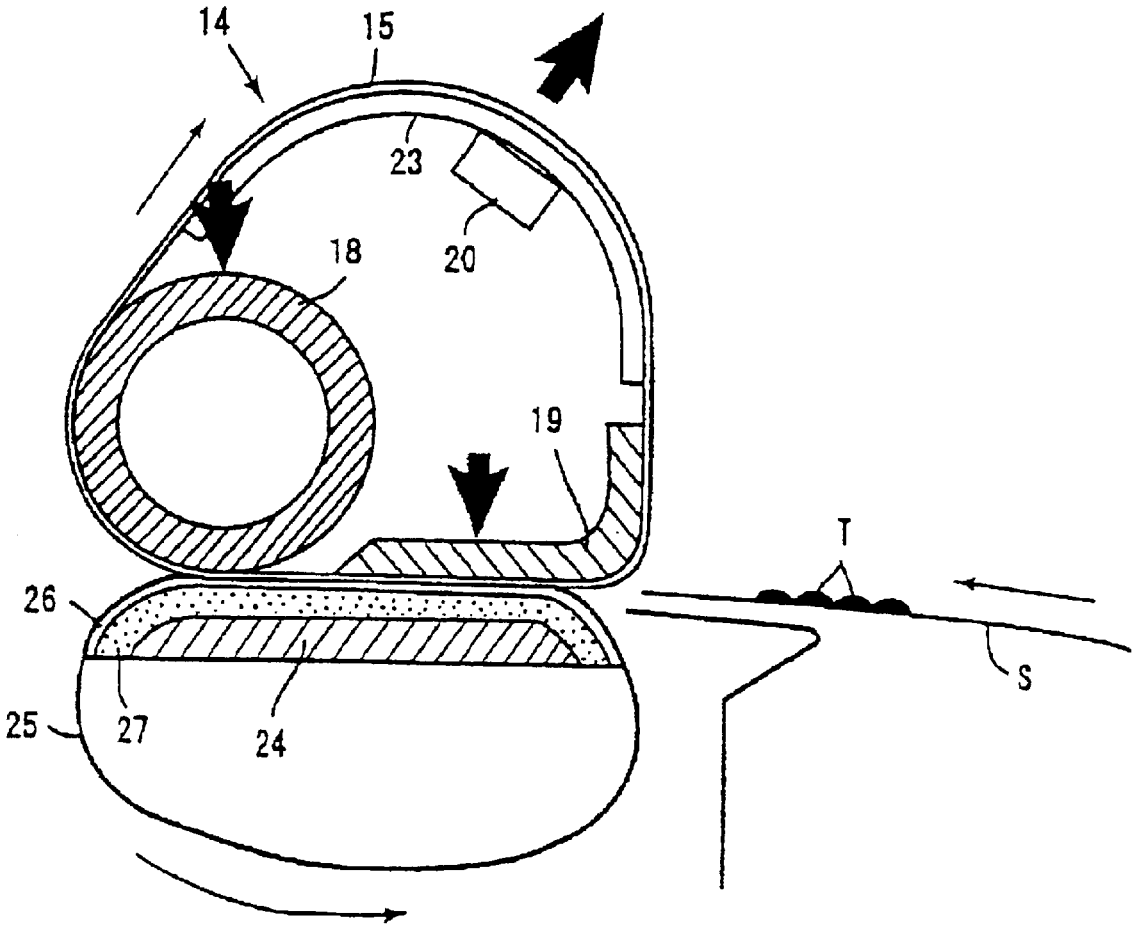
FIG. 8 shows a fifth embodiment of the fixing device in accordance with the present invention.

Reference will be made to FIG. 8 for describing a fifth embodiment of the fixing device 14 in accordance with the present invention. As shown, the fixing device 14 is similar to the configuration of FIG. 6 except that a stationary pressing member 24 is substituted for the press roller 17. The stationary pressing member 24 is formed of heat-resistant resin or metal. A pressing belt 25 is passed over the pressing member 24 and faces the belt 15 over both of the first nip L1 and second nip L2, thereby forming a sheet conveyance path. The pressing member 24 includes a friction reducing layer 26 contacting the pressing belt 25 and an elastic layer 27 intervening between the friction reducing layer 26 and the pressing member 24.

The pressing belt 25 is formed flat so as to move together with the belt 15 through the first and second nips L1 and L2 and is driven by the belt 15 at the second nip L2 to move in a direction indicated by an arrow in FIG. 8.

The pressing belt 25 differs from the press roller 17 in that it is flat and can therefore extend the nips L1 and L2, enhancing the softening and infiltration of the toner T and therefore desirable fixation. Further, part of the pressing member 25 contacting the belt 15 and heated thereby is far thinner than the press roller 17 and has thermal capacity small enough to implement rapid warm-up.

Moreover, the pressing member 24, positioned to face the reverse surface of the sheet S where the toner T is absent, can be extended to the upstream side in the direction of sheet conveyance over the inlet of the first nip L1. More specifically, the range over which heat is to be transferred from the belt 15 to the sheet S can be made longer than the belt 15 so as to form a preheating range. Such a preheating range further promotes the softening of the toner T and the infiltration of the toner T into the sheet S.

Figure 9:
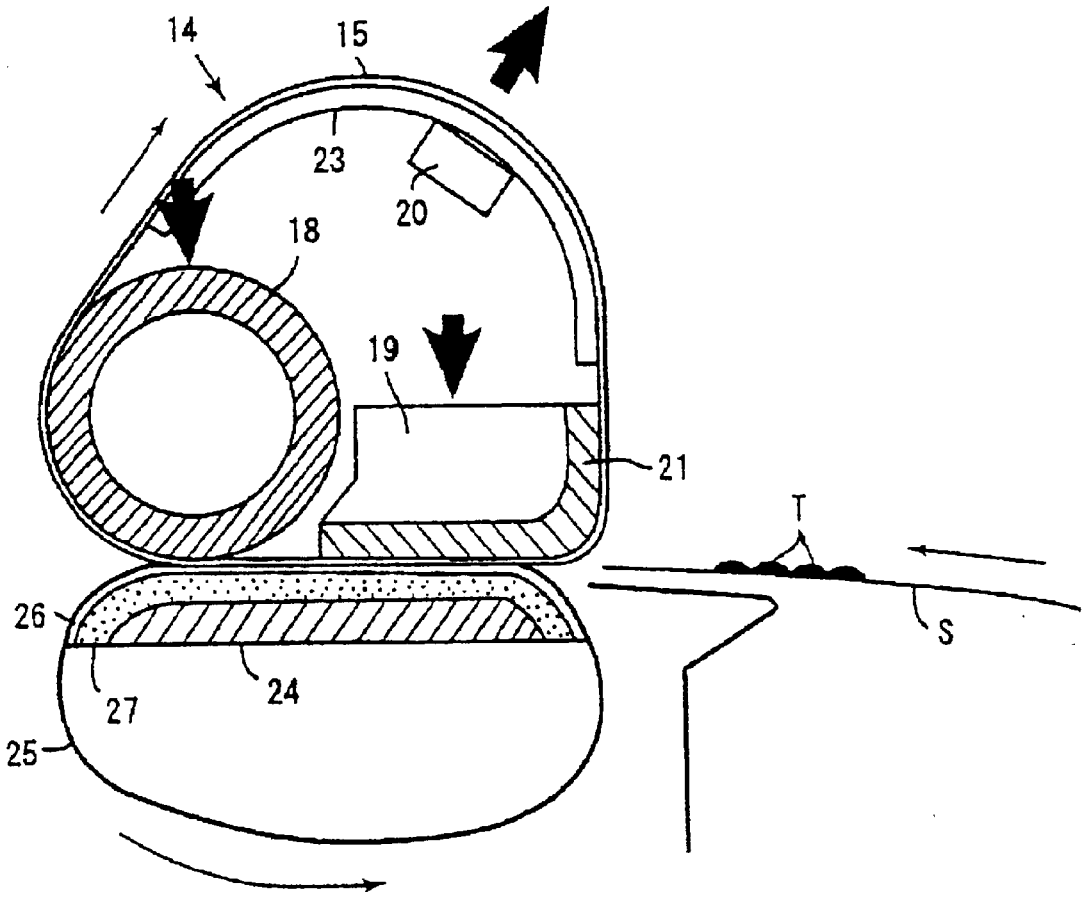
FIG. 9 shows a sixth embodiment of the fixing device in accordance with the present invention.

The configuration of the pressing member 24 may be similarly applied to the configuration of FIG. 7, as shown in FIG. 9 as a sixth embodiment of the fixing device 14 in accordance with the present invention specifically.

Figure 10:
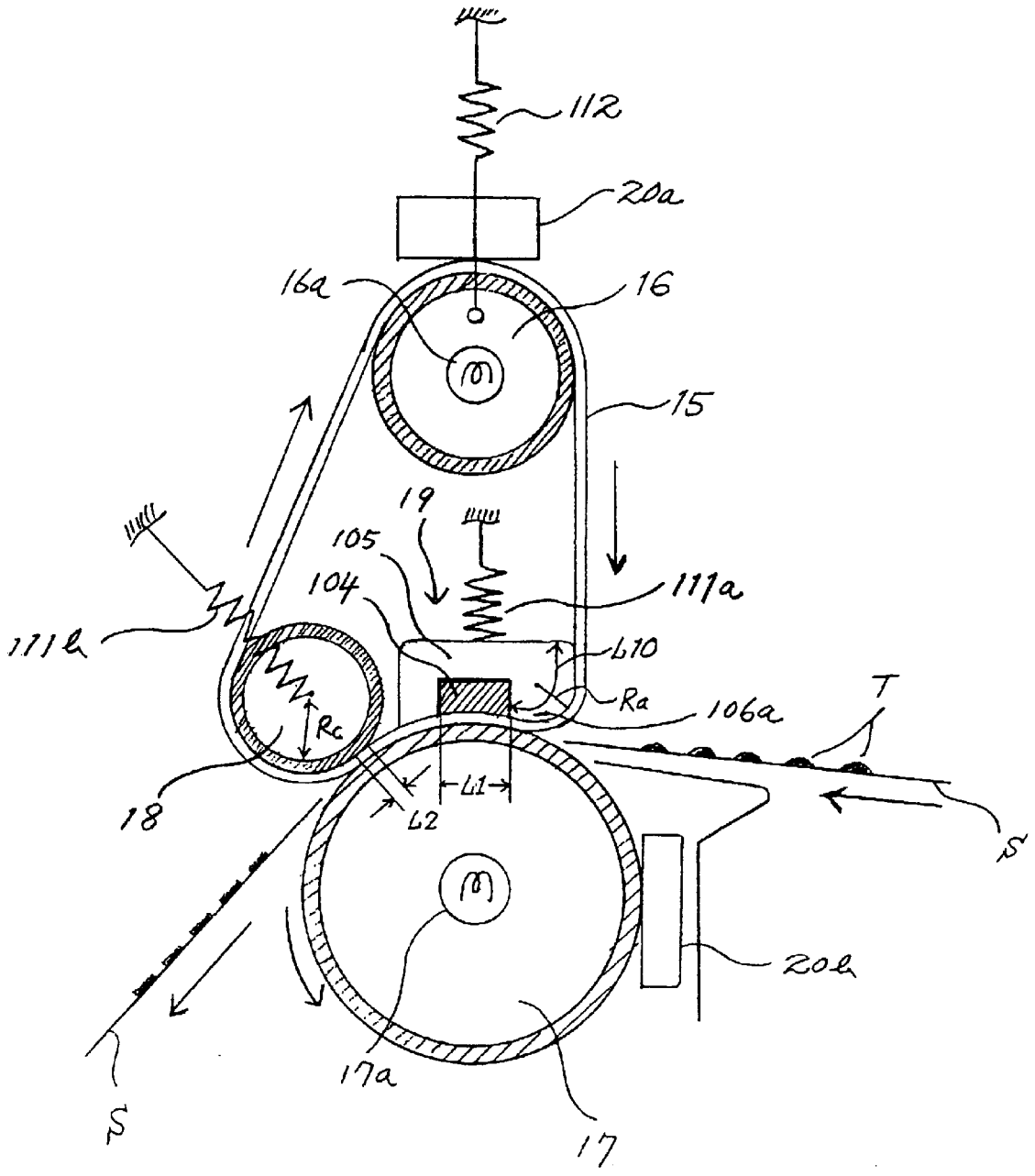
FIG. 10 shows a seventh embodiment of the fixing device in accordance with the present invention

Referring to FIG. 10, a seventh embodiment of the fixing device 14 in accordance with the present invention will be described. Generally, when a member forming a first nip is elastic, problems are apt to arise as to slide and wear resistance between the elastic member and a belt and degrade sheet conveyance and the durability of a pressing member, as discussed earlier. Experiments showed that when the elastic member was passed from a position upstream of the nip, the above problems arose more conspicuously rather at a position preceding the nip than at the nip, i.e., the position of the guide portion L10, FIG. 4. In light of this, the illustrative embodiment locates a rigid member formed of metal or resin at a position corresponding to the guide portion L10 and locates a heat-resistance elastic layer at the nip.

More specifically, as shown in FIG. 10, the fixing roller 18 is pressed against the press roller 17 by a spring 111*b* via the belt 15. Halogen heaters or heat sources 16*a* and 17*a* are disposed in the heat roller 16 and press roller 17, respectively. Thermistors 20*a* and 20*b* respectively adjoin the surface of the heat roller 16 and that of the press roller 17. The surfaces of the heat roller 16 and press roller 17 are controlled to preselected temperature in accordance with the outputs of the thermistors 20*a* and 20*b*, respectively.

In the illustrative embodiment, the stationary member 19 is made up of a heat-resistant elastic member 104 and a support member 105 supporting the elastic member 104. The elastic member 104 is formed of, e.g., silicone rubber having low hardness. Particularly, low-hardness foam silicone rubber having cells thereinside noticeably reduces warm-up time because of its heat insulating ability, as determined by experiments. Although the heat insulating ability increases with an increase in the cell ratio of foam silicone rubber, the cells are destroyed due to the constant contact of the elastic member 104 with the press roller 17 and causes the elastic member 104 to loose preselected elasticity, as also determined by experiments. In this manner, when use is made of foam silicone rubber, the low hardness and durability of the elastic member 104 have a tradeoff relation.

A conventional rubber roller formed of foam silicone rubber generally has hardness between 20 Hs and 40 Hs in terms of the Asker C scale. However, in the case of a high-speed machine that needs a great nip width and therefore high pressure, such a rubber roller must be provided with hardness as high as 50 Hs or so in terms of the Asker C scale, which reduces the cell ratio and therefore makes it difficult to reduce the warm-up time. By contrast, the heat-resistant elastic member 104 of the illustrative embodiment implements an acceptable nip width with its own width even when formed of foam silicone rubber without resorting to higher pressure. In addition, heat transfer from the belt 15 to the elastic member 104, which is formed of foam silicone rubber, is reduced, so that the temperature drop of the belt 15 is reduced.

The elastic member 104 is firmly received in a recess formed in the support member 105 and rigidly affixed to the support member 105 by, e.g., heat-resistant adhesive, allowing a minimum of deformation to occur in the elastic member 104 despite aging. While the support member 105 may be formed of sintered metal, it should preferably be formed of heat-resistant resin in order to reduce warm-up time.

A spring 111*a* constantly biases the support member 105 against the press roller 17 with preselected pressure via the belt 15. A tension spring 112 constantly biases the heat roller 16, which is disposed between the opposite runs of the belt 15, away from the elastic member 104. The force of the tension spring 112 is suitably selected within a preselected range not exceeding the force of the spring 111*a*, so that the nip formed by the elastic member 104 is not disturbed.

The support member 105 includes a projection 106*a* corresponding in position to the guide portion L10 and having preselected radius of curvature Ra. The radius of curvature Ra is selected such that when the press roller 17 and belt 15 are rotated, tension acts on the belt 15. In the illustrative embodiment, the radius of curvature Ra is selected in the range of from R10 to R20 so as to reduce resistance to sliding as far as possible when the belt 15 driven by the press roller 17 enters the nip between the elastic member 104 and the press roller 17. To further reduce resistance to act between the support member 105 and the belt 15, the friction of the support member 105 may be reduced, as will be described specifically later.

On the other hand, the fixing roller 18 has a preselected radius Rc. Just after the toner T has been fixed on the sheet S by heat at the nip L1, the belt 15 and the toner surface of the sheet S are separated from each other while passing the outlet side of the fixing roller 18. At this instant, if the radius Rc is great, then the sheet S wraps around the belt 15 due to adhesion acting between the belt 15 and the toner surface. If the radius Rc is small, then relative speed when the belt 15 and toner surface part from each other increases and allows the sheet S to part from the belt 15 by overcoming the above adhesion. In the illustrative embodiment, to reduce the load on the belt 15 and insure separation of the sheet S at the same time, the radius Rc is selected to be smaller than or equal to the curvature Ra mentioned earlier.

To reduce friction to act between the support member 105 and the belt 15, the support member 105 may not only be formed of resin or metal but also further reduced in friction. For example, fluorocarbon resin may be mixed with the material of the support member 105 in order to reduce frictional resistance between the surface of the support member 105 and the belt 15. Alternatively, the support member 105 may be covered with a friction reducing member, e.g., a glass fiber sheet coated with Teflon. Another possible implementation is coating a liquid containing fluorocarbon resin on the elastic member 104 and support member 105 and then baking the members 104 and 105 at preselected temperature to thereby form a low-friction film.

In the illustrative embodiment, the stationary member 19 includes the heat-resistant elastic member 104 positioned at the first nip L1 and the guide portion L10 formed of metal or resin positioned upstream of the elastic member 104. If desired, the guide portion L10 may be extended to the inlet of the first nip L1, i.e., one half of the elastic member 104 at the inlet side of the first nip L1 and the other half of the same at the outlet side of the first nip L1 may be respectively formed of metal or resin, which is rigid, and a heat-resistant elastic material. This alternative configuration is desirable in the following respect. Assume that a stationary member 19 formed of an elastic material is positioned at the inlet of the first nip L1. Then, the leading edge of the sheet S is softly nipped by the first nip L1, i.e., by a weak nipping force, so that the belt 15 and sheet S are apt to slip on each other and disturb the toner image T. This is particularly true with the leading edge of the sheet S. By contrast, if the rigid half of the elastic member 104 positioned at the inlet side of the first nip L1 can surely catch the leading edge of the sheet S and guide it toward the outlet of the first nip L1 via the center of the first nip L1.

It is to be noted that the relation of $Ra \geqq Rc$ stated earlier is similarly applicable to any one of the first to sixth embodiments. Also, the relation of $P1<P2$ described in relation to the first embodiment is similarly applicable to any one of the second to seventh embodiments.

In summary, it will be seen that the present invention provides a fixing device and an image forming apparatus having various unprecedented advantages, as enumerated below.

(1) A belt achieves an extended life and can stably convey a recording medium. Particularly, part of a stationary member is configured complementarily to the surface of a pressing member, so that a long, uniform first nip can be formed between the stationary member and the pressing member without resorting to a heavy load. This obviates defective transfer by the belt and prevents fixing efficiency from varying due to an irregular pressure distribution.

(2) The first nip is longer than a second nip formed between the pressing member and a member facing it. Therefore, despite that a plurality of nips are formed, toner is melted to a rubber state at the first nip beforehand and prevented from being transferred to the belt. This obviates the transfer of toner to the belt and therefore defective images even when a difference in peripheral speed occurs between the members forming the nip.

(3) The stationary member has a friction reducing portion on its surface facing the belt and therefore does not effect the slide of the belt. Consequently, there can be reduced a difference in peripheral speed that would bring about defective images.

(4) The stationary member includes a guide portion contiguous with the first nip for thereby guaranteeing a wide inlet to the first nip, so that the belt is prevented from waving or creasing when a sheet enters the nip. Moreover, the sheet is immediately moved into the nip without contacting the belt at a position upstream of the nip. This prevents toner deposited on the sheet from being transferred to the belt.

(5) The end of the stationary member and the member facing the pressing member are positioned close to each other, i.e., at a small distance from each other. Should the distance be great, the sheet might rise or slacken and render the toner image defective.

(6) Pressure to act at the second nip for a unit area is selected to be higher than pressure to act at the first nip for the unit area. This not only reduces frictional resistance between the belt and the stationary member, but also minimizes a load to act on the belt during conveyance. Therefore, there can be minimized a difference in peripheral speed between the belt and the pressing member that would bring about defective images.

(7) A plurality of grooves each extending in the direction of movement of the belt are formed in the surface of the stationary member facing the belt, reducing friction between the belt and the stationary member. This reduces the load to act on the belt during conveyance for thereby obviating the cause of a difference in peripheral speed. In addition, the grooves prevent the belt from being shifted in the direction perpendicular to the direction of movement of the belt.

Various modifications will become possible for those skilled in the art after receiving the teachings of the present disclosure without departing from the scope thereof.

What is claimed is:

1. A fixing device for fixing a toner image formed on a sheet, said fixing device comprising:

an endless belt passed over a plurality of members for conveying the sheet in contact with the toner image;

a pressing member facing said plurality of members with the intermediary of said belt;

a first member, which is one of said plurality of members, comprising a heating member for heating said belt;

a second member, comprising another of said plurality of members, and facing said pressing member with the intermediary of said belt; and a third member, comprising another of said plurality of members and comprising a stationary member facing said pressing member with the intermediary of said belt;

wherein said pressing member and said third member form a first nip therebetween while said pressing member and said second member pressed against each other form a second nip therebetween, and the toner image on the sheet is fixed by being sequentially conveyed via said first nip and said second nip, wherein said stationary member has a friction reducing portion on a surface thereof facing said belt.

2. The fixing device as claimed in claim 1, wherein said stationary member comprises one of a metal and a resin.

3. The fixing device as claimed in claim 2, wherein part of said stationary member is configured complementarily to a surface of said pressing member.

4. The fixing device as claimed in claim 2, wherein said stationary member forms a guide portion via which said belt enters said first nip.

5. The fixing device as claimed in claim 2, wherein an end of said stationary member adjacent said second member is positioned close to said second member such that said first nip and said second nip adjoin each other.

6. The fixing device as claimed in claim 1, wherein said first nip has a greater length than said second nip.

7. The fixing device as claimed in claim 1, wherein said stationary member comprises a heat-resistant elastic member located at a center of a position corresponding to said first nip, and a portion of said stationary member positioned upstream of said first nip in a direction of movement of said belt and at which said belt begins to be passed over said stationary member constitutes a guide portion via which said belt enters said first nip.

8. The fixing device as claimed in claim 7, wherein said guide portion is formed of either one of a metal and a resin.

9. The fixing device as claimed in claim 8, wherein part of said guide portion forms said first nip together with said heat-resistant elastic member.

10. A fixing device for fixing a toner image formed on a sheet, said fixing device comprising:

an endless belt passed over a plurality of members for conveying the sheet in contact with the toner image;

a pressing member facing said plurality of members with the intermediary of said belt;

a first member, which is one of said plurality of members, comprising a heating member for heating said belt;

a second member comprising another of said plurality of members and facing said pressing member with the intermediary of said belt; and a third member comprising another of said plurality of members and comprising a stationary member facing said pressing member with the intermediary of said belt;

wherein said pressing member and said third member form a first nip therebetween while said pressing member and said second member pressed against each other form a second nip therebetween, and the toner image on the sheet is fixed by being sequentially conveyed via said first nip and said second nip.

wherein pressure applied at said first nip for a unit area is lower than pressure applied at said second nip for the unit area.

11. A fixing device for fixing a toner image formed on a sheet, said fixing device comprising:

an endless belt passed over a plurality of members for conveying the sheet in contact with the toner image;

a pressing member facing said plurality of members with the intermediary of said belt;

a first member, which is one of said plurality of members, comprising a heating member for heating said belt:

a second member comprising another of said plurality of members, facing said pressing member with the intermediary of said belt; and a third member comprising another of said plurality of members and comprising a stationary member facing said pressing member with the intermediary of said belt;

wherein said pressing member and said third member form a first nip therebetween while said pressing member and said second member pressed against each other form a second nip therebetween, and the toner image on the sheet is fixed by being sequentially conveyed via said first nip and said second nip, wherein a plurality of grooves each extending parallel to a direction of movement of said belt are formed in a surface of said stationary member facing said belt.

12. A fixing device for fixing a toner image formed on a sheet, said fixing device comprising:

an endless belt passed over a plurality of members for conveying the sheet in contact with the toner image;

a pressing member facing said plurality of members with the intermediary of said belt;

a first member, which is comprises one of said plurality of members, comprising a heating member for heating said belt;

a second member comprising another said of said plurality of members and facing said pressing member with the intermediary of said belt; and a third member comprising another of said plurality of members and comprising a stationary member facing said pressing member with the intermediary of said belt;

wherein said pressing member and said third member form a first nip therebetween while said pressing member and said second pressed against each other form a second nip therebetween, and the toner image on the sheet is fixed by, being sequentially conveyed via said first nip and said second nip, wherein pressure applied at said first nip per unit area is lower than pressure applied at said second nip.

13. A fixing device for fixing a toner image formed on a sheet, said fixing device comprising:

an endless belt passed over a plurality of members for conveying the sheet in contact with the toner image;

a pressing member facing said plurality of members with the intermediary of said belt;

a first member, which is one of said plurality of members, comprising a heating member for heating said belt;

a second member comprising another of said plurality of members and facing said pressing member with the intermediary of said belt; and a third member comprising another of said plurality of members comprising a stationary member facing said pressing member with the intermediary of said belt;

wherein said pressing member and said third member pressed against each other form a first nip therebetween while said pressing member and said second member pressed against each other form a second nip therebetween, and the toner image on the sheet is fixed by being sequentially conveyed via said first nip and said second nip, wherein a plurality of grooves each extending in parallel to a direction of movement of said belt are formed in a surface of said stationary member facing said belt.

14. A fixing device for fixing a toner image formed on a sheet, said fixing device comprising:

an endless belt passed over a plurality of members for conveying the sheet in contact with the toner image;

a pressing member facing said plurality of members with the intermediary of said belt;

a first member, which is comprises one of said plurality of members, comprising a heating member for heating said belt;

a second member comprising another of said plurality of members and facing said pressing member with the intermediary of said belt; and a third member comprising another of said plurality of members and comprising a stationary member facing said pressing member with the intermediary of said belt;

wherein said pressing member and said first third member pressed against each other form a first nip therebetween while said pressing member and said second member pressed against each other form a second nip therebetween, and the toner image on the sheet is fixed by being sequentially conveyed via said first nip and said second nip, wherein a portion of said stationary member at which said belt begins to be passed over said stationary member has a preselected radius of curvature Ra, and said second member comprises a roller having a radius of curvature Rc that is smaller than or equal to the radius of curvature Ra.

15. A fixing device for fixing a toner image formed on a sheet, said fixing device comprising:

an endless belt passed over a plurality of members for conveying the sheet in contact with the toner image;

a pressing member facing said plurality of members with the intermediary of said belt;

a first member, which is comprises one of said plurality of members, comprising a heating member for heating said belt;

a second member comprising another of said plurality of members and facing said pressing member with the intermediary of said belt; and a third member comprising another of said plurality of members and comprising a stationary member facing said pressing member with the intermediary of said belt;

wherein said pressing member and said first third member pressed against each other form a first nip therebetween while said pressing member and said second member pressed against each other form a second nip therebetween, and the toner image on the sheet is fixed by being sequentially conveyed via said first nip and said second nip, wherein pressure applied at said first nip per unit area is lower than pressure applied at said second nip.

16. A fixing device for fixing a toner image formed on a sheet, said fixing device comprising:

an endless belt passed over a plurality of members for conveying the sheet in contact with the toner image;

a pressing member facing said plurality of members with the intermediary of said belt;

a first member, which is one of said plurality of members, comprising a heating member for heating said belt;

a second member comprising another of said plurality of members and facing said pressing member with the intermediary of said belt; and a third member comprising another of said plurality of members and comprising a stationary member facing said pressing member with the intermediary of said belt;

wherein said pressing member and said first third member pressed against each other form a first nip therebetween while said pressing member and said second member pressed against each other form a second nip therebetween, and the toner image on the sheet is fixed by being sequentially conveyed via said first nip and said second nip, wherein said stationary member further comprises a support portion formed of one of a metal and a resin and positioned downstream of a heat-resistant elastic member in the direction of movement of said belt, and said heat-resistant elastic member is retained between said support portion and a guide portion.

17. In an image forming apparatus comprising a fixing device for fixing a toner image formed on a sheet,said fixing device comprising:

an endless belt passed over a plurality of conveying the sheet in contact in contact with the toner image;

a pressing member facing said plurality of members with the intermediary of said belt;

a first member, which comprises one of said plurality of members;

a second member which comprises another of said plurality of members and facing said pressing member with the intermediary of said belt; and a third member, comprising another of said plurality of members and comprising a stationary member facing said pressure member with the intermediary of said belt;

wherein said pressing member and said third member pressed against each other form a first nip therebetween while said pressing member and said second member pressed against each other form a second nip therebetween, and the toner image on the sheet is fixed by being sequentially conveyed via said first nip and said second nip wherein said stationary member has a friction reducing portion on a surface thereof facing said belt.

18. In an image forming apparatus comprising a fixing device for fixing a toner image formed on a sheet, said fixing device comprising:

an endless belt passed over a plurality of members for conveying the sheet in contact with the toner image;

a pressing member facing said plurality of members with the intermediary of said belt;

a first member, which comprises one of said plurality of members;

a second member is comprising another of said plurality of members and facing said pressing member with the intermediary of said belt; and a third member comprising another of said plurality of members and comprising a stationary member facing said pressing member with the intermediary of said belt;

wherein said pressing member and said third member form a first nip therebetween while said pressing member and said second member pressed against each other form a second nip therebetween, the toner image on the sheet is fixed by being sequentially conveyed via said first nip and said second nip; and said first nip per has greater length than said second nip wherein pressure applied at said first nip per unit area is lower than pressure applied at said second nip.

19. In an image forming apparatus comprising a fixing device for fixing a toner image formed on a sheet, said fixing device comprising:

an endless belt passed over a plurality of members for conveying the sheet in contact with the toner image;

a pressing member facing said plurality of members with the intermediary of said belt;

a first member which comprises one of said plurality of members;

a second member which comprises another of said plurality of members, facing said pressing member with the intermediary of said belt; and a third member, which comprises another of said plurality of members and comprises a stationary member facing said pressing member with the intermediary of said belt;

wherein said pressing member and said third member form a first nip therebetween while said pressing member and said second member pressed against each other form a second nip therebetween, the toner image on the sheet is fixed by being sequentially conveyed via said first nip and said second nip;

said stationary member comprises a heat-resistant elastic member located at at least a center of a position corresponding to said first nip, and a portion of said stationary member positioned upstream of first nip in a direction of movement of said belt and at which said belt begins to be passed over said stationary member comprises a guide portion via which said belt enters said first nip wherein a plurality of grooves each extending parallel to a direction of movement of said belt are formed in a surface of said stationary member facing said belt.

* * * * *